United States Patent [19]

Hansen

[11] Patent Number: 4,953,788

[45] Date of Patent: Sep. 4, 1990

[54] WATER SPRAY FITTING

[75] Inventor: Albert F. Hansen, Punga Grove, New Zealand

[73] Assignee: Hansen Developments Limited, Punga Grove, New Zealand

[21] Appl. No.: 252,242

[22] Filed: Sep. 30, 1988

[51] Int. Cl.[5] ..... B05B 15/02; B05B 1/14

[52] U.S. Cl. ..... 239/107; 239/276; 239/553

[58] Field of Search ..... 239/104, 106, 107, 276, 239/553, 590, 457, 524

[56] References Cited

U.S. PATENT DOCUMENTS

| | | | |
|---|---|---|---|
| 2,130,810 | 9/1938 | Munz | 239/457 |
| 2,212,533 | 8/1940 | Zimmerman | 239/457 |
| 2,631,062 | 3/1953 | Tiedemann et al. | 239/276 |
| 3,586,239 | 6/1971 | Blass | 239/276 |
| 4,131,234 | 12/1978 | Pescetto | 239/457 |
| 4,159,805 | 7/1979 | von Lutzow | 239/524 |
| 4,752,031 | 6/1988 | Merrick | 239/457 |

*Primary Examiner*—Andres Kashnikow
*Assistant Examiner*—Karen B. Merritt
*Attorney, Agent, or Firm*—Duckworth, Allen, Dyer & Doppelt

[57] ABSTRACT

A miniature irrigation water spray fitting includes a body part having a top and a bottom and with an inlet for receiving longitudinal flow of water from the bottom. The body part also includes a depending skirt between the top and the bottom extending generally radial to the flow of water through the inlet. The cap part is threaded onto the top of the body part and has a depending edge engaging the skirt of the body part when the cap part is screwed fully home, the cap part having an outer peripheral gripping edge. One of the body or cap parts has plural radial grooves extending along the respective skirt or depending edge to permit the radial flow of water from the fitting. The cap part gripping edge permits a field worker to quickly clear any clogging of the grooves by rotating the cap part a half turn or so, and thereafter quickly rotating the cap part fully home again.

7 Claims, 1 Drawing Sheet

WATER SPRAY FITTING

BACKGROUND OF THE INVENTION

My present invention comprises a water spray fitting that is suitable for use in a small scale or miniature irrigation system, for pot plants or in a garden or nursery or the like, to provide a spray of water to individual plants or groups of plants.

Plants in a domestic green house, conservatory or the like or in a garden shop, or flowering plants in flower beds, require periodic watering to be maintained at their best. Miniature irrigation systems for such applications are increasing in popularity. Typically such a system comprises a network of small diameter water pipes and small spray fittings with a spray fitting being situated near each plant or group of plants, or otherwise at suitable intervals.

A problem with many available forms of miniature spray fitting is clogging of the spray outlets. The water outlets are very small and typically of the order or less than 1 mm in diameter, and they are thus prone to clogging from particles of dirt in the water supply for example. In addition, such fittings are typically and most conveniently formed from plastics by injection moulding, and it is difficult to form the small diameter bores comprising the outlet apertures to consistent dimensions.

SUMMARY OF THE INVENTION

The invention provides an improved or at least alternative form of water spray fitting for such miniature irrigation systems.

In broad terms the invention may be said to comprise a water spray fitting for a miniature irrigation system, comprising a body part and a cap part adapted to threadedly mount to the body part, wherein one of the body part and cap part comprises an extending face and the other comprises at least one groove adapted to co-operate with said face to extend across said face from a water supply port to the exterior of the fitting when the cap part is screwed onto the body part to define a spray outlet of the fitting, whereby said spray outlet may be opened for cleaning by loosening of said cap part on said body part.

Preferably said extending face is an annular face and a number of the grooves are found in the other part to define a plurality of spray outlets for the fitting.

Typically the water spray fitting of the invention may be mounted in a plant pot a few inches above the soil for example, to direct the flow of water downwardly from the fitting onto the soil around the base of the plant, or outwardly or upwards towards the plant and/or such that it falls to earth over the general area surrounding the plant. The fitting may include means whereby the fitting may be mounted to a small support rod or the like that ma be inserted into the soil adjacent the plant, with the height of the fitting above the soil being adjustable by inserting deeper or withdrawing partially the rod from the soil, or alternatively by moving the fitting on the rod, to vary the area of coverage.

BRIEF DESCRIPTION OF THE DRAWING

A preferred form of water spray fitting in accordance with the invention is illustrated in the accompanying drawings, by way of example, wherein.

DESCRIPTION OF THE PREFERRED EMBODIMENT

Figure 1:
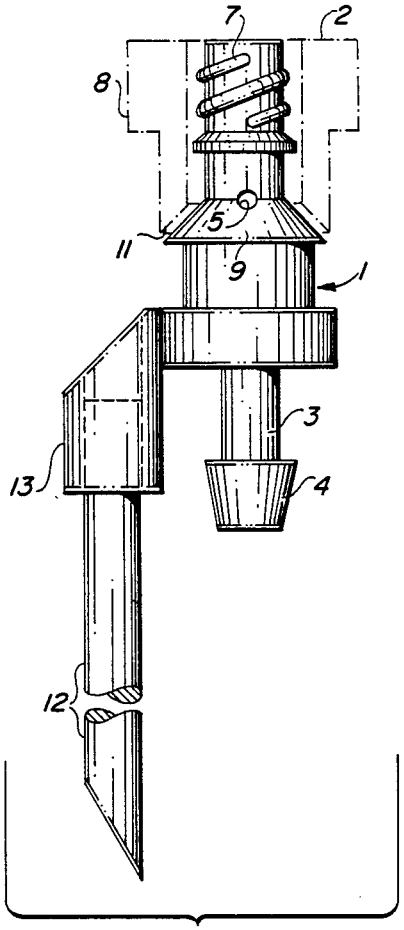
FIG. 1 is a side view of the preferred form fitting showing the cap part thereof in phantom outline mounted to the body part.

The preferred form fitting comprises the body part and cap part referred to, generally indicated at reference numerals 1 and 2. In the preferred form the body part 1 is shaped as shown and comprises a water inlet portion 3 with a barb 4 whereby the fitting is adapted to be connected to a small diameter water supply pipe as typically employed in a miniature irrigation system. The fitting has a generally hollow interior, and ports 5 through the side of the body part of the fitting communicate the interior of the body part to the exterior. In use, water under pressure may flow from the water supply pipe into the hollow interior of the fitting via the inlet portion 3 and exit from the ports 5.

The cap part 2 is threadedly mounted to the body part by mating threads 7 formed on the exterior of the body part and the interior of the central bore of the cap part, so that the cap part 2 may be screwed onto the cap part 1. The cap part, which is generally cylindrical in the preferred form, comprises a gripping portion 8.

An extending face of the body part of the fitting is defined in the preferred form by annular skirt 9 which extendsabout the body part below the base of the upright portion on which the threads 7 on the body part are provided.

Figure 2:
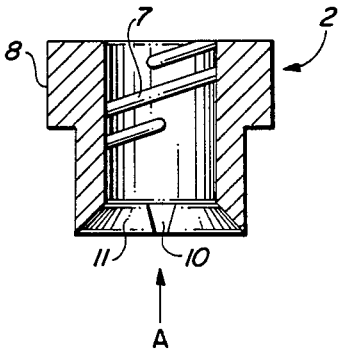
FIG. 2 is a cross sectional view through the cap part of the preferred form fitting.
Figure 3:
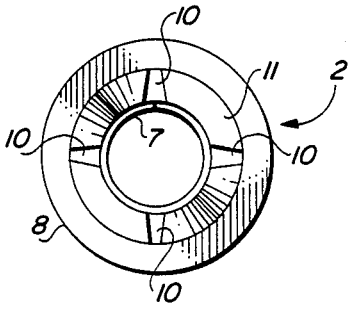
FIG. 3 is a view from below in the direction of arrow A in FIG. 2 of the cap part of the fitting.

Grooves 10 are formed on a lower portion of the cap part 2. The grooves 10 are shallow and extend outwardly across the lower edge 11 of the cap part as shown in FIGS. 2 and 3. When the cap part 2 is screwed home on the body part 1 spray outlets for the fitting are defined between each groove 10 and the skirt face 9. In use water exiting the ports 5 will pass under pressure from these spray outlets.

In the preferred form shown the skirt face 9 and the co-operating grooves 10 in the cap part are angled such that the water spray will be directed generally downwardly at an angle as shown, but in other forms the grooves and co-operating face could be oriented so that the spray is directed generally horizontally, or upwardly.

In the preferred form the grooves 10 are formed in the cap part and the face which co-operates with the grooves to form the spray outlets is formed in the body part, but the grooves 10 could be formed in the body part and the co-operating face on the cap part in other embodiments.

With the arrangement of the invention the small spray outlets of the miniature fitting may be unblocked or cleared by unscrewing the cap part from the body part and removing any dirt or other blockages in the grooves. In many cases simply partial unscrewing of the cap by a half turn or so for a second while the system is on and the fitting carries water under pressure will be sufficient to allow any foreign matter to escape, so that blockages can be cleared very easily. In addition, a new cap part can be installed to the fitting at low cost. This is in contrast with a number of known forms of fittings wherein the permanently formed spray outlets are very difficult if not impossible to clean if blocked, with fine wire for example, due to their small size. In addition the grooves rather than small outlet holes are more readily moulded in plastic, which is the preferred material for fittings of this type.

The preferred form fitting is adapted to be mounted in use by way of a small rod 12 the end of which is received in a rod receiving part 13 of the fitting as shown in FIG. 1. The fitting may for example form part of a system for watering of a pot plant. The rod with fitting mounted and water supply pipe attached would be inserted into the soil of the plant pot adjacent the plant and the height of the fitting set such that the swathe of water delivered by the fitting would cover the desired area. This area could be increased or decreased by raising or lowering the fitting respectively.

The foregoing describes the invention including a preferred form thereof. Alterations and modifications as will be obvious to those skilled in the art ar intended to be incorporated within the scope hereof, as defined in the following claims.

I claim:

1. A water spray fitting for a miniature irrigation system, comprising a body part and a cap part adapted to threadedly mount to the body part, wherein one of the body part and cap part comprises an extending face and the other comprises plural grooves adapted to cooperate with said face to extend across said face from a water supply port to the exterior of the fitting when the cap part is screwed onto the body part to define a spray outlet of the fitting, whereby said spray outlet may be opened for cleaning by loosening of said cap part on said body part, said extending face being an annular face extending about said body or cap part and said plurality of grooves are formed in said other part to define a plurality of said spray outlets of the fitting, said annular face and said grooves being angled such that the water spray exits in a generally downward direction from the fitting in use, and wherein said body part comprises an upright portion carrying threads for mounting said cap part and an annular skirt portion extending about the base of said upright part and comprising said annular face, and wherein said cap part comprises said grooves in a lower portion thereof which engages said annular face when the cap part is screwed fully home.

2. A water spray fitting as claimed in claim 1, wherein the fitting is adapted for mounting over the soil adjacent a plant whereby the dimension of the swathe of spray exiting the fitting may be adjusted by adjusting the height of the fitting.

3. A miniature plastic moulded irrigation spray fitting, comprising a body part and a cap part, the body part comprising an upright portion carrying threads and a skirt portion extending about the base of the upright portion and providing a downwardly directed annular face extending about the base of the upright portion, the cap part comprising a gripping portion about the exterior of the cap part and being adapted to threadedly mount on the body part and comprising an annular face about the base of the cap part arranged to engage the body part face when the cap part is screwed home on the body part, and at lest one of either the body part face or cap part face having at least one groove extending across the face from a water supply port from the interior to the exterior of the body part adjacent said face, such that a spray outlet of the fitting is defined when the cap part is screwed home onto the body part, whereby said spray outlet may be opened for cleaning by loosening of the cap part on the body part.

4. A miniature irrigation as claimed in claim 3, comprising a plurality of said grooves in said face to define a plurality of spray outlets of the fitting.

5. A water spray fitting as claimed in claim 4, wherein the annular faces of the body and cap parts are angled such that the water spray exits in the generally downward direction from the fitting in use, and wherein the fitting is adapted for mounting over the solid adjacent a plant whereby the dimension of the swathe of spray exiting the fitting may be adjusted by adjusting the height of the fitting.

6. A miniature irrigation water spray fitting, comprising:

a body part having a top and a bottom, and with a water inlet portion for receiving a longitudinal flow of water from the bottom, the body part further including a depending skirt between the top and the bottom extending generally radial to the flow of water through the inlet portion;

a cap part threaded onto the top of the body part and having a depending edge engaging the skirt of the body part when the cap part is screwed fully home, the cap part including a gripping edge about its outer periphery;

one of the body or cap parts having plural radial grooves extending along the respective skirt or depending edge to permit the radial flow of water from the fitting;

the body part comprising an upright portion carrying threads for mounting the cap part and an annular skirt portion extending about the base of the upright part and comprising an annular face, the cap part including the grooves in a lower portion thereof engaging the annular face when the cap part is screwed fully home; and wherein the gripping edge along the outer periphery of the cap part permits a field worker to quickly clear any clogging of the grooves by rotating the cap part relative to the body part.

7. The fitting recited in claim 6 wherein said grooves extend so that water spray exits in a generally downward direction from the fitting during use.

* * * * *